US006213656B1

(12) United States Patent
Piccinino, Jr. et al.

(10) Patent No.: US 6,213,656 B1
(45) Date of Patent: Apr. 10, 2001

(54) PHOTOGRAPHIC PROCESSING APPARATUS HAVING IMPROVED LIGHT-LOCK FEATURE

(75) Inventors: Ralph L. Piccinino, Jr., Rush; Kevin H. Blakely, Rochester; Timothy W. Herman, Bergen, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/356,209

(22) Filed: Jul. 16, 1999

(51) Int. Cl.[7] ..... G03D 17/00; G03D 13/04

(52) U.S. Cl. ..... 396/599; 396/603; 396/612; 396/620; 396/636

(58) Field of Search ..... 396/512, 511, 396/513, 594, 597, 598, 599, 602, 603, 612, 617, 620, 636

(56) References Cited

U.S. PATENT DOCUMENTS

| | | | | |
|---|---|---|---|---|
| 3,408,141 | | 10/1968 | Grant, Jr. | 396/615 |
| 4,067,034 | | 1/1978 | Kwiatkowski | 396/594 |
| 4,116,400 | * | 9/1978 | Jones et al. | 396/512 |
| 5,448,326 | | 9/1995 | Pummell et al. | 396/613 |
| 5,864,728 | * | 1/1999 | Earle et al. | 396/615 |

* cited by examiner

*Primary Examiner*—D. Rutledge
(74) *Attorney, Agent, or Firm*—Frank Pincelli

(57) ABSTRACT

An apparatus for processing a photosensitive media. The apparatus having a processing path for passing of a photosensitive media through the apparatus, and a light-lock feed slot assembly for allowing the photosensitive media to be fed into the processing path. The light-lock feed slot assembly comprises of a conduit having an inlet port at one end and an outlet port at the other end. The conduit has a configuration which forms a substantially serpentine passageway between the inlet port and the outlet port such that stray light which may be adjacent the entrance port is prevented from reaching the outlet port.

13 Claims, 4 Drawing Sheets

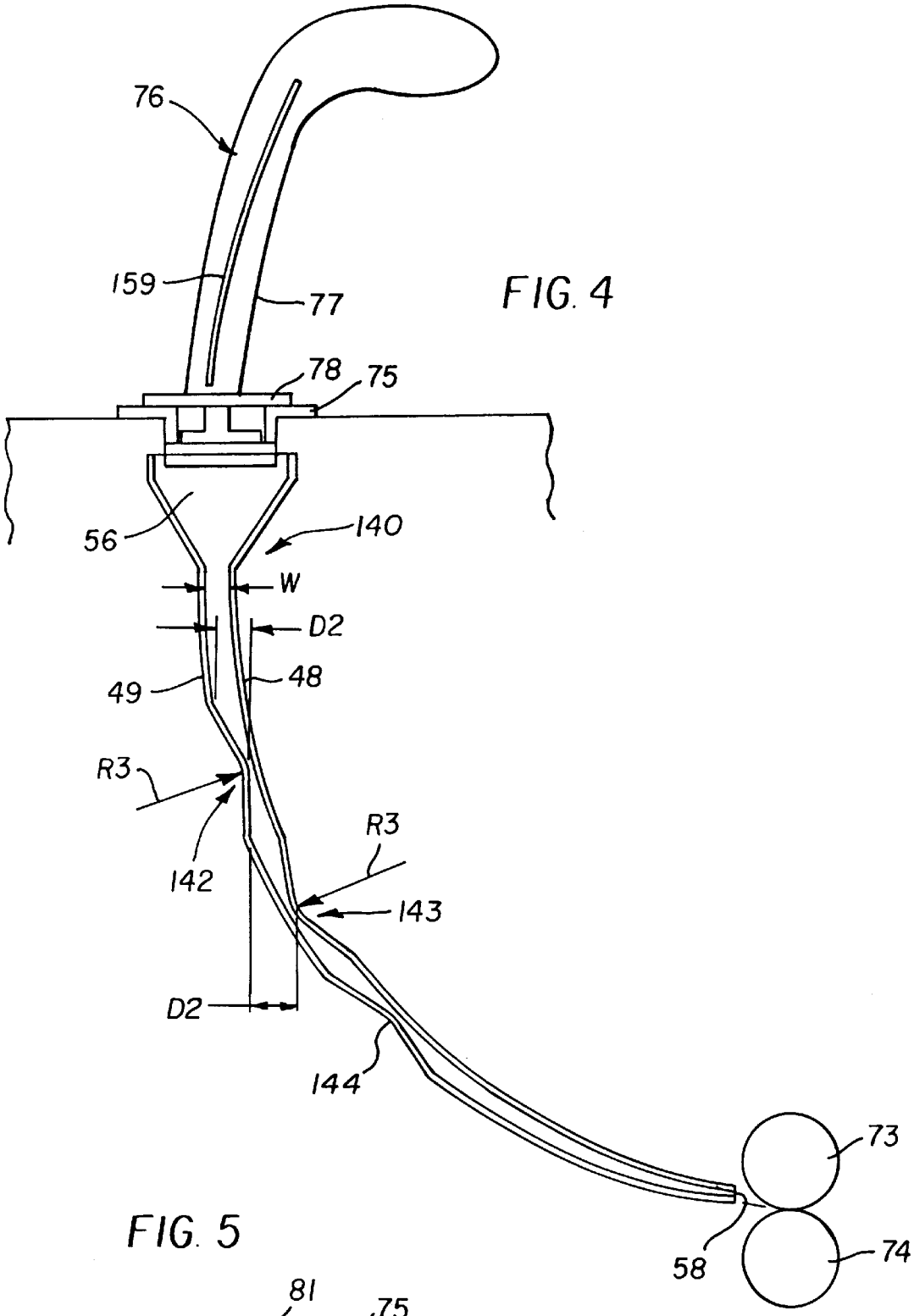
FIG. 4
FIG. 5
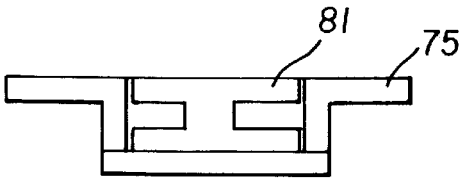

PHOTOGRAPHIC PROCESSING APPARATUS HAVING IMPROVED LIGHT-LOCK FEATURE

FIELD OF THE INVENTION

The present invention is directed to a developing apparatus for developing of a photosensitive media.

BACKGROUND OF THE INVENTION

In a typical prior art minilab, there is provided an entrance for feeding a photosensitive media to a processing path along which a photosensitive media is passed for printing and development. As is typical with minilabs, the device is designed to prevent unwanted exposure of the photosensitive media as it moves from the printing section to the processing section. With such processors, it is often necessary to provide an alternate feed slot for allowing control strips, which are used for monitoring printers and processors, to be located at a particular point in the processing path after printing. In the prior art, the alternate feed slot is required to have a relatively complex light-lock mechanism in order to avoid the entrance of stray light into the device, which can adversely affect the media passing through the processor.

Applicants have invented an improved light-lock mechanism for a photosensitive feed slot, which allows a photosensitive media, such as a control strip, to be easily passed into the processor to the processing path at the appropriate location, which requires little or no special devices and allows quick and easy entrance of a photosensitive media into the processing path.

SUMMARY OF THE INVENTION

In accordance with one aspect of the present invention there is provided an apparatus for processing a photosensitive media, the apparatus having a processing path extending between the entrance and outlet for passing of a first photosensitive media through the apparatus, and a light-lock feed slot assembly for allowing a second photosensitive media to be fed into the processing path, the light-lock feed slot assembly comprising:

a conduit having a pair of oppositely disposed side walls, each of the side walls having an interior surface forming an inlet port, an outlet port and a narrow feed channel between the inlet port and outlet port, the inlet port extending to the exterior of the apparatus and the conduit being positioned for directing of the photosensitive media to the processing path, the conduit having a curved configuration from the inlet port to the outlet port, each of the side walls having at least one projecting member which extends along the width of the channel, extending toward the opposed side wall, the projecting member having a configuration so as to substantially stop light from exiting the outlet port which originates from the entrance port such that there is substantially no light interference with the media passing through the processing path.

In accordance with another aspect of the present invention there is provided an apparatus for processing a photosensitive media, the apparatus having a processing path for passing of a photosensitive media from the entrance to the outlet through the apparatus, and a light-lock feed slot assembly for allowing the photosensitive media to be fed into the processing path, the light-lock feed slot assembly comprising:

a conduit having an inlet port at one end and an outlet port at the other end, the conduit having a configuration which forms a substantially serpentine passageway between the entrance port and the outlet port such that stray light which may be adjacent the entrance port is prevented from reaching the outlet port.

The above and other objects, advantages and novel features of the present invention will become more apparent from the accompanying detailed description thereof when considered in conjunction with the following drawings.

BRIEF DESCRIPTION OF THE DRAWINGS

In the detailed description of the preferred embodiments of the invention presented below, reference is made to the accompanying drawings in which:

FIG. 4 is a view similar to FIG. 2 illustrating a modified alternate feed slot assembly made in accordance with the present invention; and FIG. 5 is an enlarged cross-sectional view of the top portion of the feed slot assembly of FIGS. 2 and 3 illustrating a plug for closing entry to the alternate feed slot assembly.

DETAILED DESCRIPTION OF THE INVENTION

The present description will be directed in particular to elements forming part of, or in cooperation more directly with, the apparatus in accordance with the present invention. It is understood that elements not specifically shown or described may take various forms well known to those skilled in the art.

Figure 1:
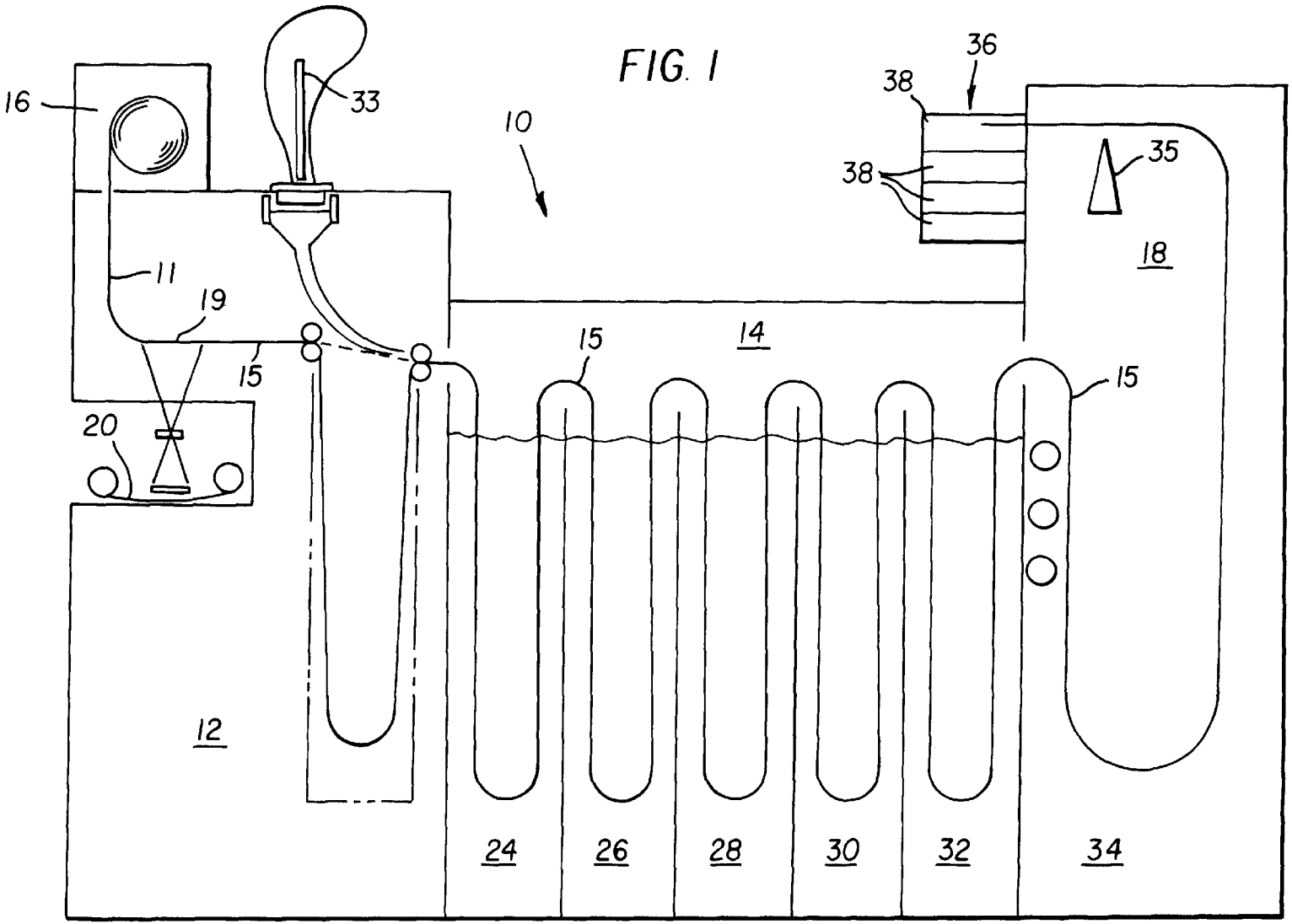
FIG. 1 illustrates a photofinishing apparatus made in accordance with the present invention.

Referring to FIG. 1, there is illustrated a photofinishing apparatus 10 made in accordance with the present invention. In the particular embodiment illustrated, the photofinishing apparatus 10 comprises what is typically referred to as a minilab wherein images are first exposed onto a photosensitive media 11 in a printing section 12 and then passed through a processing section 14 where the images exposed on the media 11 are developed. The photosensitive media 11 travels along a processing path 15 starting at supply section 16 in printing section 12. After passing through the processing section 14, the photosensitive media 11 is then passed to a finishing station 18 wherein the photosensitive media 11 goes through a cutting operation and a sorting operation for sorting of individual prints. A supply of a photosensitive media 11 is provided at a supply section 16, which in the particular embodiment illustrated the photosensitive media 11 comprises photographic paper provided in web form. Images are exposed on the media 11 at a print gate 19. In the embodiment illustrated, images on film, such as photographic negative film, which has been previously developed, are optically exposed onto media 11. The photosensitive media 11 travels along a processing path 15 through the printing section 12 and processing section 14. After printing the image on media 11, the media 11 passes onto the developer section 14 wherein the exposed photosensitive media 11 is developed by passing it through a plurality of processing tanks containing appropriate processing solutions. In particular, the photosensitive media 11 passes through a first development tank 24 wherein the latent images formed on the photosensitive media 11 are developed. The development tank contains an appropriate processing solution for developing of the images. After passing through the development tank, the photosensitive media 11 passes through tanks 26,28,30,32. In the particular embodiment illustrated, tank 26 is a bleach fix tank containing a bleach fix processing solution and tanks 28,30,32 each contain a washing solution for washing of the photosensitive media as it passes there through. It is, of course, to be understood that any desired number of processing tanks may be provided containing any appropriate processing solution required or desired for processing of photosensitive media passing there through.

After passing through the processing tanks, the photosensitive media 11 passes through dryer 34 and then onto cutter 35 wherein individual images are cut from the web of photosensitive media 11 so as to form individual prints and then to sorter 36 where the individual prints are placed into appropriate sorting bins 38, typically by customer order.

It is often necessary with photofinishing devices to send an undeveloped test strip 33 of a photosensitive media through the processors for determining the condition of a printer and/or of the processing section/processor. As is typically found in minilabs, an alternate feed slot assembly 40 is provided for allowing entry of the test strip at a midpoint of the processing path 13 such that the test strip 33 will pass through only the desired section of the processing section, typically at a point such that test strip 33 will pass through each of the processing tanks 24,26,28,30,32 and then through the dryer 34.

Figure 2:
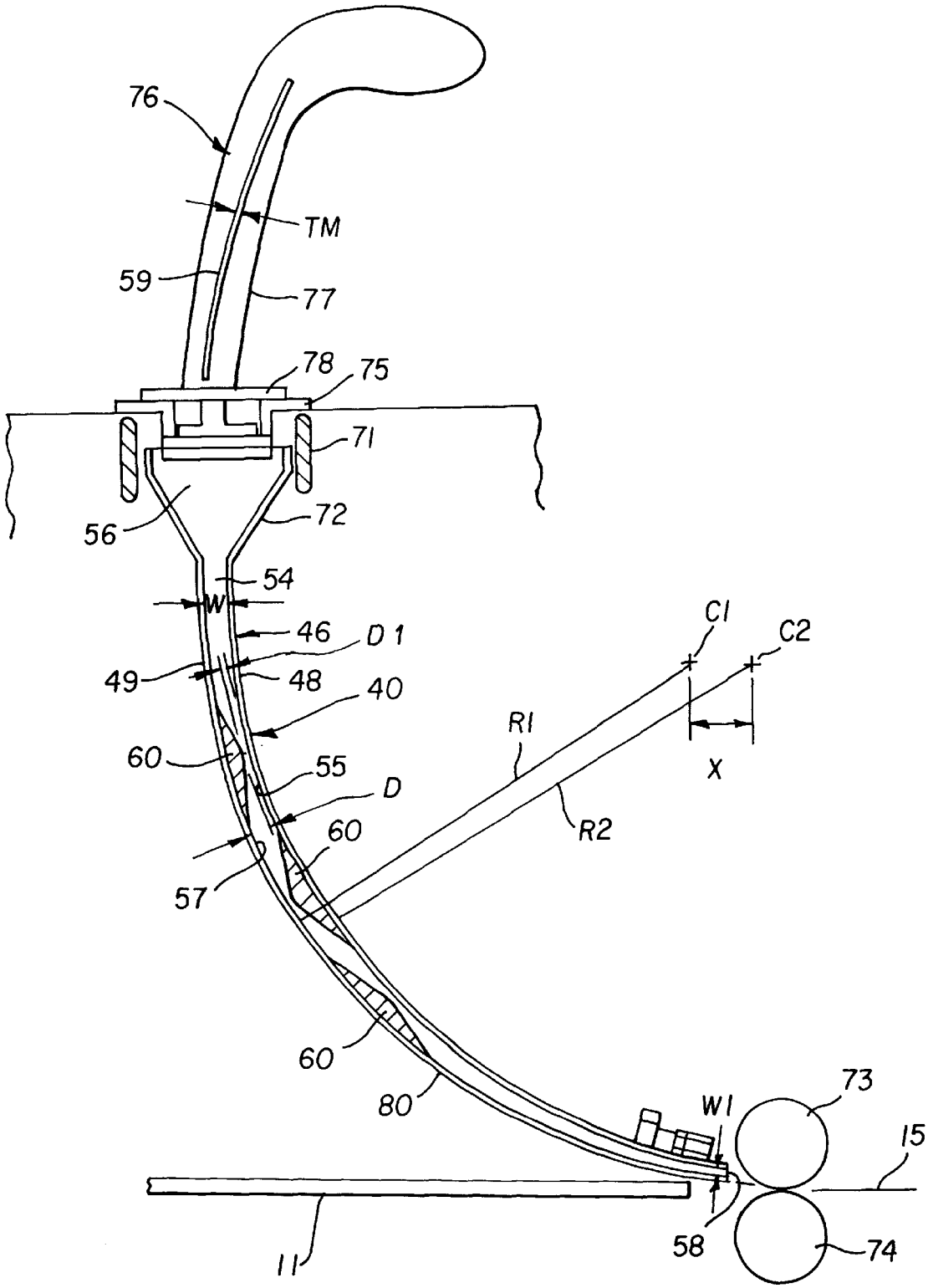
FIG. 2 illustrates an enlarged partial cross-sectional view of the apparatus of FIG. 1 illustrating in greater detail an alternate feed slot assembly made in accordance with the present invention and having a package assembly mounted thereto.
Figure 3:
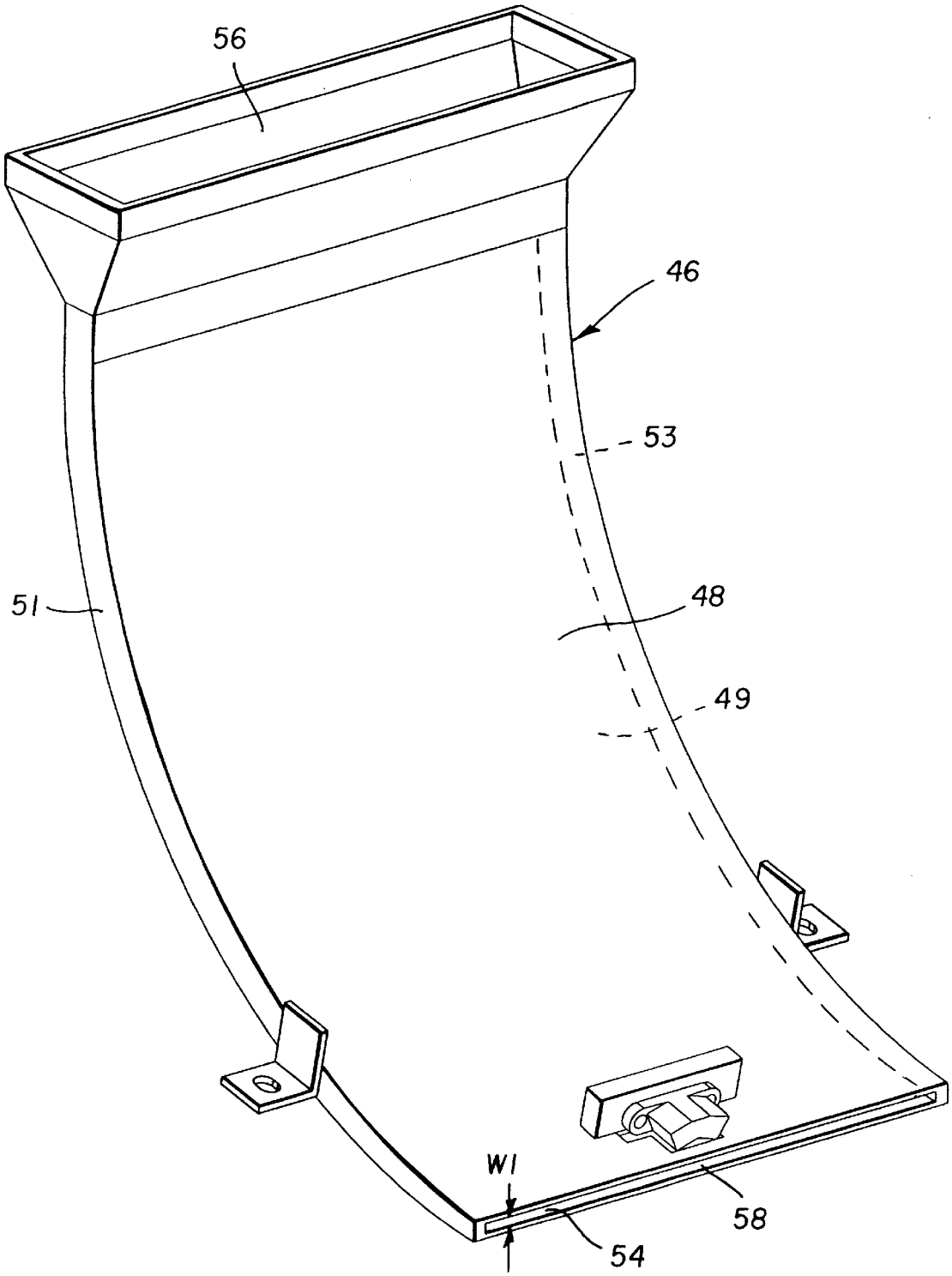
FIG. 3 is a perspective view of the conduit of FIG. 2.

Referring to FIGS. 2 and 3, there is illustrated an enlarged cross-sectional view of a light-lock feed slot assembly 40 made in accordance with the present invention. The light-lock feed slot assembly 40 is located in the printing section 12 and comprises a conduit 46 having a pair of substantially parallel side walls 48, 49 and end walls 51,53, which form a narrow processing channel 54. Locating the light-lock feed slot assembly 40 in the printing section 12, as opposed to the processing section 14, minimizes the possibility of adversely affecting the light tight condition of the processing section 14 and the photosensitive media passing there through. The channel 54 has a width W measured at the upper region of channel 54 in the range of about 4 mm to 8 mm. In the particular embodiment illustrated, the channel 54 has a width W of about 4 mm. However, the width W may be selected as desired and will vary with the thickness of the media passed through the conduit. In the embodiment illustrated the width W is such that a media having a thickness of about 0.33 mm will pass there through. The side walls 48,49 have respective interior surfaces 55,57. The conduit 46 at one end is provided with an inlet port 56, which allows access from the exterior of photofinishing apparatus 10 and at the other end to an outlet port 58 for directing of a photosensitive media 11 to the processing path 13. The conduit 46 in the embodiment illustrated has a generally arcuate configuration from the inlet port 56 to outlet port 58 for allowing a test strip or other photosensitive material to be easily passed there through to the processing path. The arcuate configuration assists in minimizing light from traveling from inlet port 56 through conduit 46 to the outlet port 58. The conduit configuration is such that the side walls 48,49 each follow a generally circular path having a radius R1 and R2, respectively. In the embodiment illustrated R1 is equal to R2. Preferably, the radius R1 and R2 are such that the outlet is displaced a horizontal distance from the inlet port a distance equal to or greater than the distance W and will allow the photosensitive media 11 to easily pass through channel 54. In the embodiment illustrated the center of radius C1, C2 of radius R1 and R2, respectively, for each of side walls 48,49, respectively, are spaced apart a small distance X so that the channel 54 becomes smaller as it approaches outlet port 58 so as to provide for a smaller width W1 at outlet port 58. W1 is such that the media can easily pass there through without any substantial restriction in movement. In the embodiment illustrated, width W1 is about 1.5 mm. The offset centers C1, C2 provides greater control of the media leaving exit port 58 so that the media is properly directed to the processing path 15. Applicants have found that a conduit having a curved arcuate path for the conduit 46 may not be sufficient to avoid the entrance of stray light which can adversely affect photosensitive material passing through the photofinishing apparatus 10. Applicants have found that there should preferably be provided at least one projecting member 60 on each of the interior surfaces 55,57 of side walls 48,49. Preferably, the projections 60 are such that they each extend from the wall into the conduit a distance D, at least a distance equal to or greater than half the distance W between the side walls so as to form a serpentine path through which the photosensitive media 11 passes. Preferably, the projection extends in the conduit a distance at least two-thirds of the distance W. This is done so that any light that may be entering the inlet port will be blocked by the providing of the projections 60. Preferably, the exterior surface 61 of the projections 60 are relatively smooth so that any photosensitive material being passed through the conduit will not catch or be caught on any of the projections 60. Additionally, the projections 60 are spaced along the length of interior surface 55,57 so that substantially all of the light that may be adjacent the inlet port 56 does not reach the outlet port 58. Applicants have found, as illustrated in the particular embodiment, that a pair of projections 60 are provided on the interior surface 57 of wall 49, whereas a single projection is provided on the interior surface 55 of wall 48 and is positioned between the two. Preferably, the projections 60 extend a distance D from the side wall, such that the remaining distance D1 from the opposing side wall is slightly greater than the thickness TM of the media 59 (test strip) going there through, preferably, D1 is not more than about four times the thickness TM of the media passing there through. It is to be understood that any desired numbers of projections 60 may be provided and actual dimension may be varied so long as no substantial light is allowed to enter apparatus 10 that will have an adverse affect on the photosensitive media passing there through.

In the particular embodiment illustrated, the inlet port 56 is designed such that conduit 46, just prior to reaching the top 70 of the photofinishing apparatus 10, has a flared-out section 72 provided for allowing easy insertion of the test strip into the channel 54. A light-tight peripherally extending boot 71 is provided around the upper end of conduit 46 which engages a mounting bracket 75 secured to the top of apparatus 10. The mounting bracket 75 is designed to receive a light-tight package assembly 76 comprising a package 77, mounting collar 78 secured to the package 77 for allowing a photosensitive media 79 contained within the package 77 to be dispensed from the package 77. The collar 78 is designed to provide a light-tight engagement with mounting bracket 75. The mounting bracket 75 is preferably substantially flush with the top of the photofinishing apparatus 10. When a package assembly 76 is not mounted to apparatus, the light-lock assembly still prevents the entry of light into the apparatus that will have a substantial affect on the undeveloped photosensitive media passing through the apparatus 10. However, if desired, a plug (not shown), may be provided for mounting bracket 75 when no package assembly 76 is provided so as to prevent inadvertently having something go into conduit 46, which could cause damage to the apparatus and/or media being passed there through. Preferably, the plug has a top surface which is substantially flush with the top surface of the apparatus 10.

It is, of course, understood that any appropriate package may be provided for mating with the inlet port 56 for allowing transfer of the a test strip 59 or any other desired media to the alternate feed slot assembly 40.

In order to more clearly understand the present invention, a brief description of the operation of apparatus 10 will now be discussed.

When it is desired to pass media onto the processing path 13, a package assembly 76 is provided with a photosensitive media 59 therein, such as a test strip. The test strip 59 is passed through the inlet port 56 into conduit 46 to outlet port 58 and is fed directly to a pair of rollers 73,74, wherein at least one of the rollers is a drive roller. The rollers 73,74 are used for advancing photosensitive media 11 through the processing path, which has been received from the printing section 12. As can be seen, the outlet port 58 is positioned such that the media 11 passing through the conduit 46 will be fed directly to the nip of the rollers 73,74 for transporting through the test strip to the processing path 15. The test strip passes through the processing section in the normal manner, except for cutting and sorting. The curved conduit 46 provides an additional benefit in that when properly positioned within the apparatus, the back side 80 can be used as a guide for the top surface of photosensitive media traveling along the processing path 15.

In the embodiment illustrated in FIGS. 1 and 3, the light-lock feed slot assembly 40 is provided with a generally arcuate conduit 46 having internal projections. However, the present invention is not restricted to such embodiment. Referring to FIG. 4, there is illustrated a modified light-lock feed slot assembly 140 made in accordance with the present invention. The light-lock feed slot assembly 140 is similar to assembly 40, like numerals indicating like parts and functions. In this embodiment, conduit 146 is provided with side walls 48,49, which are configured so as to provide a generally serpentine configuration. In particular, the conduit 46 is shaped such that there is provided a first curved section 142, a second curved section 143 and a third curved section 144, each having a radius of curvature R3. In the preferred embodiment, each of the curved sections 142, 143, 144 have the same radius of curvature, however, the present invention is not limited to such. The radius of curvature R3 is such that the photosensitive media 11 may be easily passed there through, but is of sufficient curvature to prevent any substantial light from reaching outlet port 58. In this regard, preferably the first curved section 142 is displaced horizontally with respect to the inlet port 56 a distance D2 equal to at least the thickness W of the passageway formed by the conduit. Preferably, the second curved section 143 is also displaced from the first curved section 142 a distance D2, which is equal to or greater than the thickness W of the passage formed by the conduit 46. The third curved section 144 is displaced from the second curved section in the same manner. While in the preferred embodiment three curved sections 142,143,144 are provided, it is to be understood that any desired number of curved sections may be provided. Also, in the preferred embodiment illustrated, the portion of the conduit 46 adjacent the outlet port 48 is configured so that the photosensitive media 11 will smoothly enter the processing path 15. It can be seen that in this embodiment the light-lock assembly 140 directly provides a serpentine path, through which the media 11 passes which prevents stray light from entering the inlet port 56 from reaching the outlet port 58 such that the photosensitive media 11 passing there through will not be adversely affected.

Various other features may be provided as desired. For example, as illustrated in FIGS. 1–3, a media sensor 90 may be provided for sensing when a media passes by outlet port 58 so that the rollers 73,74 are activated for transporting of the media to processing path 15.

The invention has been described in detail with particular reference to certain preferred embodiments thereof, but it will be understood that variations and modifications can be effected within the spirit and scope of the invention.

Parts List

10 photofinishing apparatus
11 photosensitive media
12 printing section
13 processing path
14 processing section
15 processing path
16 supply section
18 finishing station
19 print gate
20 Film
24 Development tank
26 Bleach fix tank
28,30,32 Washing tanks
33 Test strip
34 Dryer
35 Cutter
36 Sorter
38 Sorting bins
40 Feed slot assembly
46 Conduit
48,49 Side walls
51,53 End walls
50,52 Interior surface
54 Processing channel
55,57 Interior surfaces
56 Inlet port
58 Outlet port
59 Media (test strip)
60 Projecting member
61 Exterior surface
70 Top of apparatus
71 Boot
72 Flared-out section
73,74 Rollers
75 Mounting bracket
76 Package assembly
77 Package
78 Mounting collar
79 Photosensitive media
80 Back side
81 Plug
90 Media sensor
140 Feed slot assembly
142,143,144 Curved section
146 Conduit
160 Light-tight package
162 Outlet

What is claimed is:

1. An apparatus for processing a photosensitive media, said apparatus having a processing path for passing of a first photosensitive media through the apparatus, and a light-lock feed slot assembly for allowing a second photosensitive media to be fed into said processing path at a point along said processing path, said light-lock feed slot assembly comprising:

a conduit having a pair of oppositely disposed side walls, each of said side walls having an interior surface forming an inlet port, an outlet port and a narrow feed channel between said inlet port and outlet port, said inlet port extending to the exterior of said apparatus and said conduit being positioned for directing of the photosensitive media to said processing path, said conduit having a curved configuration from the inlet port to the outlet port, each of said side walls having at least one projecting member which extends along the width of the channel, extending toward the opposed side wall, said projecting member having a configuration so as to substantially stop light from exiting the outlet port which originates from the entrance port such that there is substantially no light interference with the media passing through the processing path.

2. An apparatus according to claim 1 wherein said conduit has generally arcuate configuration having a radius of curvature such that the outlet port is displaced a distance equal to or greater than at least the distance said walls are spaced apart.

3. An apparatus according to claim 1 wherein the walls of said conduit are spaced apart a predetermined distance W, each of the projecting members extends a distance equal to at least one-half of the distance W.

4. An apparatus according to claim 3 wherein the distance between said projecting members and said wall opposite said projecting member is not more than twice the thickness of said first photosensitive media.

5. An apparatus according to claim 1 wherein the outer surface of each of said projecting members is substantially smooth.

6. An apparatus according to claim 1 wherein said processing path comprises a printing section for printing onto said first photosensitive media and developer section for developing of the image printed on said first photosensitive media in said printing section.

7. An apparatus according to claim 1 wherein said projections form a generally serpentine path.

8. An apparatus according to claim 1 wherein a plug is provided for said inlet port when said light-lock feed slot assembly is not being used.

9. An apparatus according to claim 8 wherein said plug has a top surface which is substantially flush with the top surface of said apparatus when properly secured to said light-lock feed slot assembly.

10. An apparatus according to claim 1 wherein the conduit adjacent the inlet port is flared out.

11. An apparatus according to claim 1 wherein one of the side walls has a back side which acts as a guide to the media passing along said first processing path.

12. An apparatus according to claim 1 wherein said apparatus includes a printing section and a processing section, said conduit is located in said printing section.

13. An apparatus for processing a photosensitive media, said apparatus having a processing path for passing of a photosensitive media from a supply section through the apparatus, and a light-lock feed slot assembly for allowing the photosensitive media to be fed into said processing path, said light-lock feed slot assembly comprising:

a conduit having an inlet port at one end and an outlet port at the other end, said conduit having a configuration which forms a substantially serpentine passageway between said inlet port and said outlet port such that stray light which may be adjacent said inlet port is prevented from reaching said outlet port; and a plug is provided for said inlet port when said light-lock feed slot assembly is not being used.

* * * * *